US007820115B2

(12) United States Patent
Zatechka, Jr. et al.

(10) Patent No.: US 7,820,115 B2
(45) Date of Patent: Oct. 26, 2010

(54) ADJUSTABLE LABORATORY RACK

(75) Inventors: Steven Zatechka, Jr., Cordova, TN (US); Francis Gomes, Lincoln Park, NJ (US); David Landsberger, Caldwell, NJ (US)

(73) Assignees: Bel-Art Products, Inc., Pequannock, NJ (US); St. Jude's Children's Research Hospital, Inc., Memphis, TN (US)

( * ) Notice: Subject to any disclaimer, the term of this patent is extended or adjusted under 35 U.S.C. 154(b) by 437 days.

(21) Appl. No.: 11/809,048

(22) Filed: May 30, 2007

(65) Prior Publication Data

US 2008/0299012 A1 Dec. 4, 2008

(51) Int. Cl.

| | |
|---|---|
| ***B01L 9/00*** | (2006.01) |
| *B01L 3/00* | (2006.01) |
| *B66F 3/00* | (2006.01) |

(52) U.S. Cl. ..... 422/104; 422/99; 422/102; 254/126

(58) Field of Classification Search ..... 422/104
See application file for complete search history.

(56) References Cited

U.S. PATENT DOCUMENTS

| | | | | |
|---|---|---|---|---|
| 2,189,989 | A | 2/1938 | Lichtman | |
| 2,863,626 | A | 1/1955 | Anderson | |
| 3,119,588 | A | 1/1962 | Keats | |
| 3,980,227 | A | 9/1976 | Witty et al. | |
| D248,407 | S | 7/1978 | Bassett et al. | |
| 4,124,122 | A | 11/1978 | Emmitt | |
| 4,276,048 | A | 6/1981 | Leaback | |
| 4,389,374 | A * | 6/1983 | Sutton et al. | 422/104 |
| 4,787,523 | A | 11/1988 | Kalous | |
| 4,819,900 | A | 4/1989 | Funk | |
| 4,827,780 | A | 5/1989 | Sarrine et al. | |
| 5,076,445 | A | 12/1991 | Landsberger | |
| 5,169,603 | A | 12/1992 | Landsberger | |
| 5,271,896 | A | 12/1993 | Jakubowicz et al. | |
| 5,284,623 | A | 2/1994 | Yamori et al. | |
| 5,483,903 | A | 1/1996 | Pierce et al. | |

(Continued)

FOREIGN PATENT DOCUMENTS

| | | |
|---|---|---|
| WO | WO 02/026387 A1 | 9/2001 |

OTHER PUBLICATIONS

BelArt Catalog 2004, pp. 103-117.

*Primary Examiner*—Sam P Siefke
*Assistant Examiner*—Bryan T Kilpatrick
(74) *Attorney, Agent, or Firm*—Lowenstein Sandler PC

(57) ABSTRACT

A laboratory rack assembly for supporting columns and receptacle tubes and other paraphernalia during laboratory procedures such as such as filtration, chromatography, plasma preparation, affinity purification, and so on, includes upper and lower support portions that are connected together for relative sliding movement. An upper rack module is connected to the upper support portion and is configured to receive at least one column. A lower rack module is connected to the lower support portion and is configured to receive at least one receptacle tube. At least one of the rack modules is removably connected to at least one of the support portions. An adjustment mechanism is operably associated with the upper and lower support portions for adjusting a position of one support portion with respect to the other support portion to thereby vary the distance between the upper and lower rack modules.

39 Claims, 14 Drawing Sheets

U.S. PATENT DOCUMENTS

| | | | | |
|---|---|---|---|---|
| 5,505,318 | A | 4/1996 | Goff | |
| 5,622,676 | A | 4/1997 | Lind | |
| 5,632,388 | A | 5/1997 | Morrison et al. | |
| 5,673,801 | A | 10/1997 | Markson | |
| 5,681,017 | A | 10/1997 | Clausen | |
| 5,685,510 | A | 11/1997 | Frankish | |
| 5,789,259 | A | 8/1998 | Wardlaw | |
| 5,996,818 | A | 12/1999 | Boje et al. | |
| 6,112,913 | A | 9/2000 | Rindoks et al. | |
| 6,116,163 | A | 9/2000 | Mitchell | |
| 6,170,675 | B1 | 1/2001 | Follman et al. | |
| 6,212,793 | B1 | 4/2001 | Goad | |
| 6,274,088 | B1 | 8/2001 | Burbaum et al. | |
| 6,358,470 | B1 | 3/2002 | Higuchi | |
| 6,481,586 | B1 | 11/2002 | Hoff | |
| 6,758,448 | B1 | 7/2004 | Williams et al. | |
| 6,803,018 | B1 | 10/2004 | Stiller | |
| 6,846,456 | B2 | 1/2005 | Acosta et al. | |
| 6,887,431 | B1 | 5/2005 | Vann et al. | |
| 6,908,226 | B2 | 6/2005 | Siddiqui et al. | |
| 7,040,591 | B1 | 5/2006 | Simon | |
| 7,111,825 | B2 * | 9/2006 | Landsberger et al. | ..... 254/126 |
| 2005/0186119 | A1 | 8/2005 | Itoh | |
| 2006/0186386 | A1 | 8/2006 | Landsberger et al. | |

* cited by examiner

ADJUSTABLE LABORATORY RACK

BACKGROUND OF THE INVENTION

The present invention relates generally to support racks, and more particularly to an adjustable laboratory rack with interchangeable rack modules.

Many biological, medical and other science laboratories often conduct analysis of biological or chemical samples. Such analysis may require purification of the sample and/or isolation of one or more components of the sample. By way of example, molecular biological applications for purifying nucleic acid or protein is a universal and necessary chore and generally involves the simultaneous isolation and purification of numerous different samples. Nucleic acid purification typically involves the use of column purification using silica-bead based technology during washing steps to immobilize the nucleic acid sample. Protein purification often involves similar column-based technology whereby an upper affinity column may use a magnetic-based affinity for a particular antibody during washing steps, or a resin-based technology that immobilizes the protein of interest during subsequent washing steps. Elution solutions may then be applied to the column and when lowered into a corresponding lower receptacle, the soluble nucleic acid or protein can be collected.

It has been found, however, that cross contamination can occur from adjacent samples since elution material that comes off the column drop by drop may infiltrate other samples. This is often the result of using make-shift support racks that hold multiple columns and support tubes, which are often difficult to manipulate. Although stackable racks have been provided to address this problem, they require constant assembly and disassembly while changing columns and recovery tubes. Consequently, cross-contamination, spillage, sample loss, and so on may occur. In addition, the components of such racks are often misplaced or parted out to complete other racks.

BRIEF SUMMARY OF THE INVENTION

According to one aspect of the invention, a laboratory rack assembly includes upper and lower support portions that are connected together for relative sliding movement. An upper rack module is connected to the upper support portion and is configured to receive at least one column. A lower rack module is connected to the lower support portion and is configured to receive at least one receptacle tube. At least one of the rack modules is removably connected to at least one of the support portions. An adjustment mechanism is operably associated with the upper and lower support portions for adjusting a position of one support portion with respect to the other support portion to thereby vary the distance between the upper and lower rack modules.

According to a further aspect of the invention, an adjustable laboratory rack includes upper and lower support portions that are connected together for relative sliding movement. The upper support portion has an upper rear wall and upper side walls that extend forwardly from opposite ends of the upper rear wall and an upper rack module that extends between the upper side walls. The lower support portion has a lower rear wall and lower side walls that extend forwardly from opposite ends of the lower rear wall and a lower rack module that extends between the lower side walls. An adjustment mechanism is operably associated with the upper and lower support portions for adjusting a position of one support portion with respect to the other support portion.

BRIEF DESCRIPTION OF THE DRAWINGS

The foregoing summary as well as the following detailed description of the preferred embodiments of the present invention will be best understood when considered in conjunction with the accompanying drawings, wherein like designations denote like elements throughout the drawings, and wherein.

Figure 1:
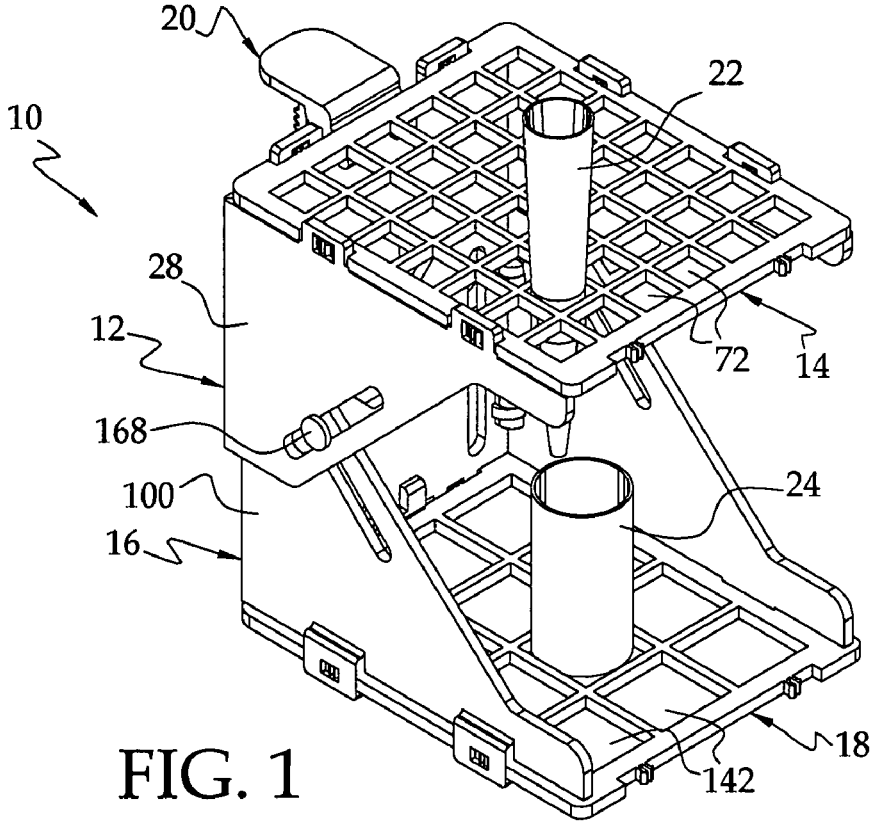
FIG. 1 is a front isometric view of an adjustable and portable laboratory rack in an extended position in accordance with a first embodiment of the present invention.

It is noted that the drawings are intended to depict only typical or exemplary embodiments of the invention. It is further noted that the drawings may not be necessarily to scale. Accordingly, the drawings should not be considered as limiting the scope of the invention. The invention will now be described in greater detail with reference to the accompanying drawings.

DETAILED DESCRIPTION OF THE INVENTION

Referring to the drawings, and to FIGS. 1, 2 and 4-9 in particular, a portable, adjustable laboratory rack assembly 10 in accordance with an exemplary embodiment of the present invention is illustrated. The adjustable laboratory rack 10 preferably includes an upper support portion 12 with an upper rack module 14 and a lower support portion 16 with a lower rack module 18. The upper and lower support portions are connected together for relative sliding movement between an extended rack position (FIGS. 1 and 8) and a retracted rack position (FIGS. 2 and 9), as will be further described. An adjustment mechanism 20 is connected to the upper and lower support portions to control the relative sliding movement and thereby adjust the distance between the upper and lower rack modules. The upper rack module 14 is adapted to receive one or more columns 22 or the like and the lower rack module 18 is adapted to receive one or more receptacle tubes 24 or other vessels that may be used during laboratory procedures such as filtration, chromatography, plasma preparation, affinity purification, and so on.

Figure 3:
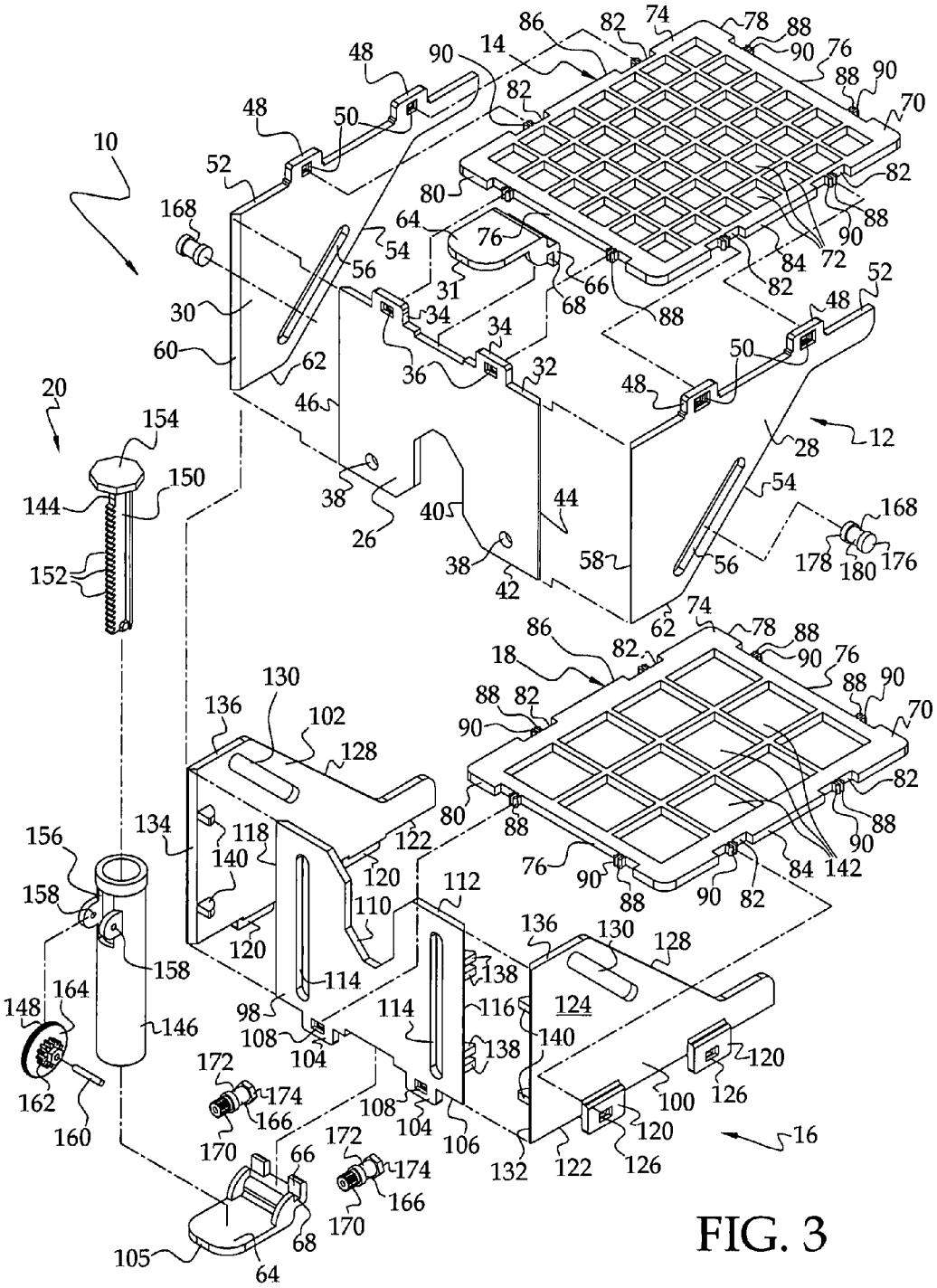
FIG. 3 is a rear isometric exploded view of the laboratory rack.

With additional reference to FIG. 3, the upper support portion 12 preferably includes an upper rear wall 26, upper side walls 28, 30 that extend forwardly from opposite ends of the upper rear wall, and an upper adjustment support 31 that extends rearwardly from the upper rear wall.

The upper rear wall 26 preferably includes a pair of upper rear tabs 34 that extend upwardly from an upper edge 32. An aperture 36 extends through each rear tab 34. An upper window 40 is formed in the rear wall 26 and extends upwardly from a lower edge 42 of the rear wall. A pair of openings 38 are formed in the rear wall 26 on either side of the upper window 40. Side edges 44, 46 of the upper rear wall 26 extend between the upper edge 32 and lower edge 42 and are preferably chamfered at an angle of 45 degrees to accommodate the upper side walls 28, 30.

Each of the upper side walls 28, 30 preferably includes a pair of upper side tabs 48 that extend upwardly from an upper edge 52. A stepped aperture 50 extends through each side tab 48. When assembled, the tabs 48 and apertures 50 of one side wall are in alignment with the tabs and apertures of the other side wall. A forward edge portion 54 of each side wall is oriented at an angle of approximately 45° with respect to horizontal and an elongate side slot 56 preferably extends parallel with the forward edge portion. A rear edge 58 of the upper side wall 28 and a rear edge 60 of the upper side wall 30 extend between the upper edge 52 and a lower edge 62 and are preferably chamfered at an angle of 45° to accommodate the chamfered side edges 44 and 46, respectively, during assembly.

The upper side walls are preferably connected to the upper rear wall by juxtaposing the rear chamfered edge 58 of the side wall 28 with the side chamfered edge 44 of the rear wall 26 and the rear chamfered edge 60 of the side wall 30 with the side chamfered edge 46 of the rear wall so that the side walls 28, 30 are parallel with each other and perpendicular with the rear wall 26. The side walls can be connected to the rear wall through any well known connection means such as adhesive bonding, welding, fastening, clamping, cooperative locking members on the side walls 28, 30 and rear wall 26, and so on. In addition to or alternatively of the connection means, the side walls and rear wall can be connected together by the upper rack module 14. It will be understood that the chamfered edges of the side walls and rear wall may be replaced with right-angled corners, rounded edges, and so on. In accordance with a further embodiment of the invention, the rear wall 26 and the side walls 28, 30 may be integrally formed together with a living hinge located between each side wall and the rear wall so that the side walls can be bent to a transverse or perpendicular position with respect to the rear wall.

The upper adjustment support 31 preferably includes a platform 64 and an arm 66 that extends downwardly from the platform. A groove 68 is formed in the arm and is sized for receiving a portion of the upper edge 32 located between the tabs 34 of the upper rear wall 26 during assembly of the upper adjustment support to the upper rear wall 26. The upper adjustment support 31 may be secured to the upper rear wall 26 using well-known connection means such as press-fitting, adhesive bonding, welding, fastening, clamping, cooperative locking members on the arm 66 and upper rear wall 26, and so on. Alternatively, the upper adjustment portion 31 may be integrally formed with the upper rear wall 26.

The upper rack module 14 preferably includes a rectangular-shaped panel 70 with a plurality of openings 72 for receiving a plurality of columns or receptacle tubes and an outer frame 74 surrounding the openings. A notch 76 is formed in the forward edge 78 and rearward edge 80 of the outer frame 74. Likewise, a pair of spaced notches 82 are formed in the side edges 84, 86 of the outer frame 74. A single pair of opposing locking projections 88, 90 extend into the notches 82, while a double pair of opposing locking projections 88, 90 extend into the notches 76. The distance between pairs of locking projections 88, 90 along one side of the outer frame 74 is preferably equal to a distance between corresponding apertures 36 or 50, so that the locking projections are received into the apertures in a snap-fit engagement.

Figure 3A:
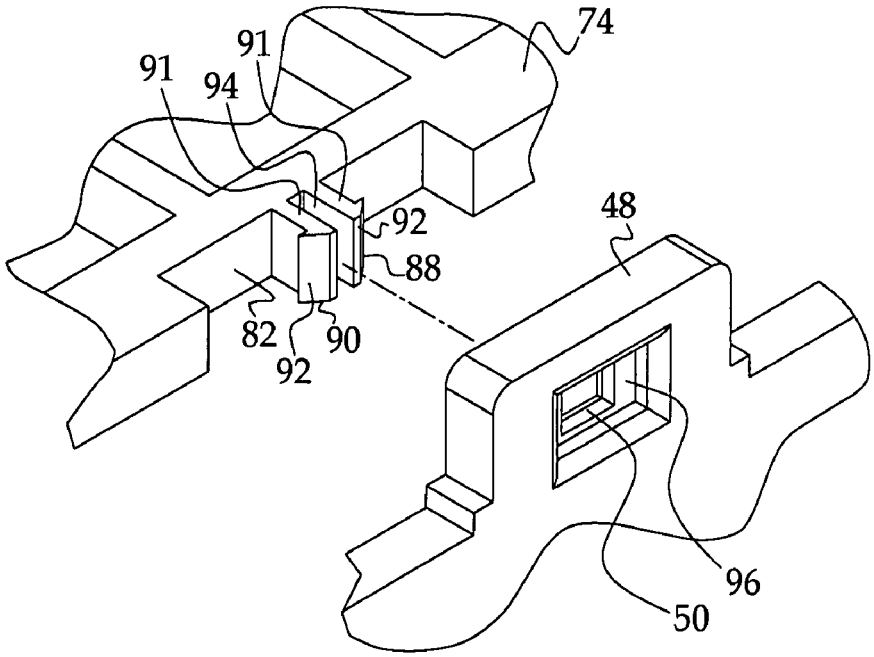
FIG. 3A is an enlarged isometric exploded view of a pair of locking projections and a corresponding side tab for connecting the rack module to the upper support portion of the laboratory rack.
Figure 3B:
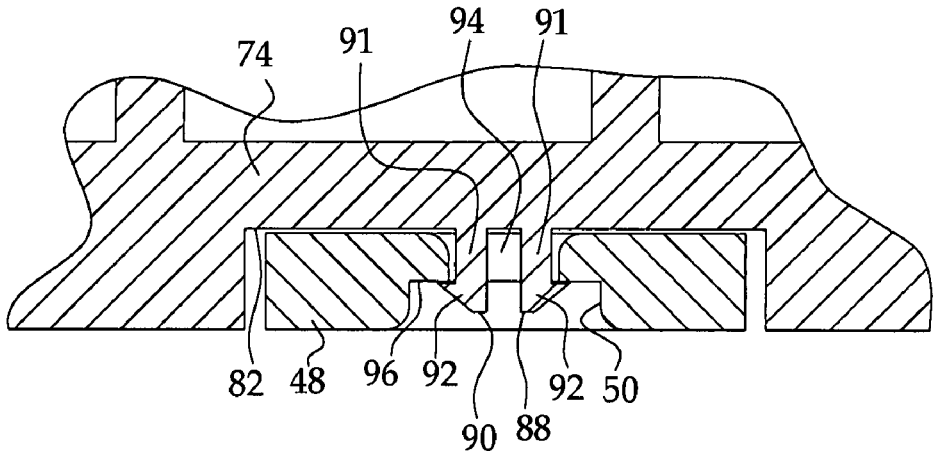
FIG. 3B is an enlarged sectional view showing interaction of the locking projections and corresponding tab.
Figure 4:
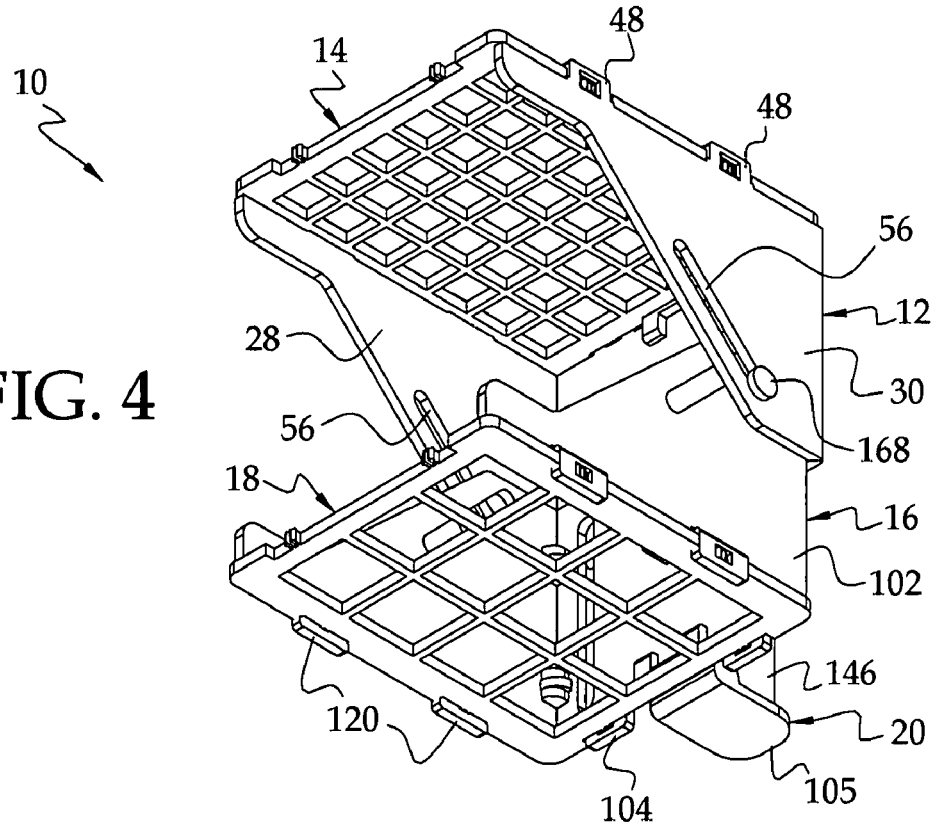
FIG. 4 is a bottom front isometric view of the laboratory rack.
Figure 5:
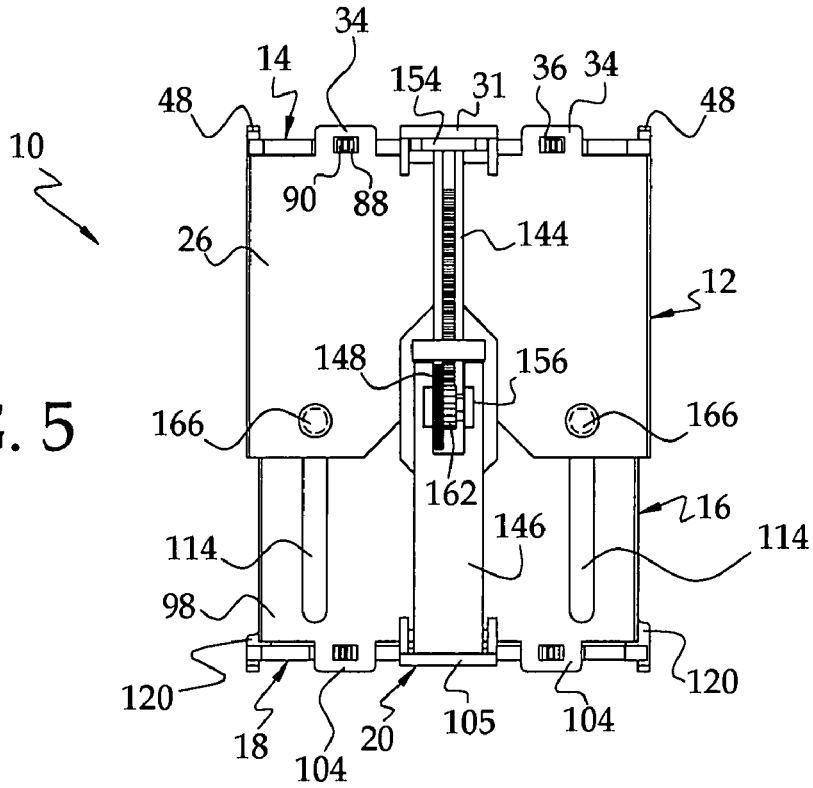
FIG. 5 is a rear elevational view of the laboratory rack.
Figure 6:
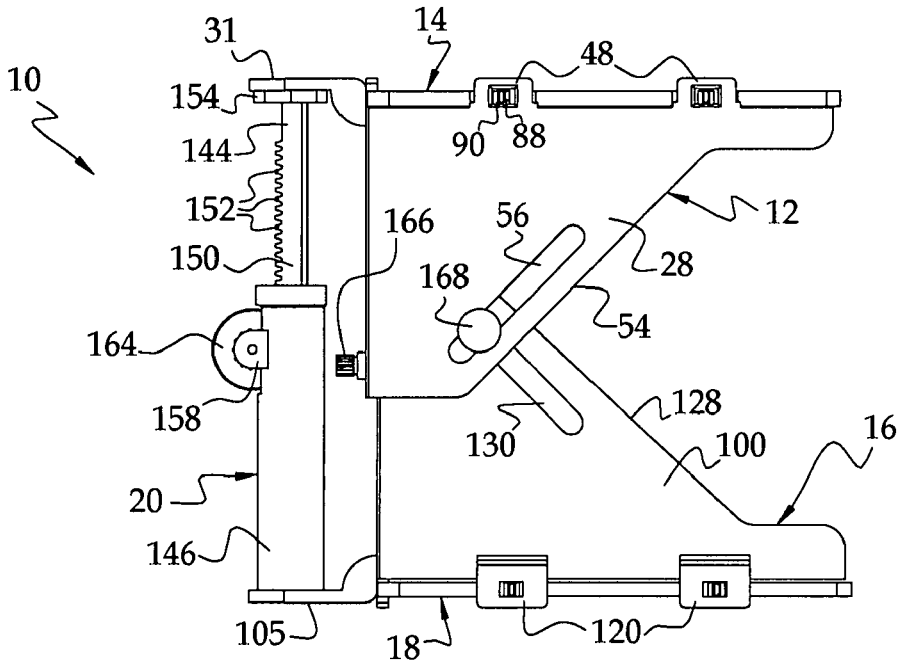
FIG. 6 is a side elevational view of the laboratory rack.
Figure 7:
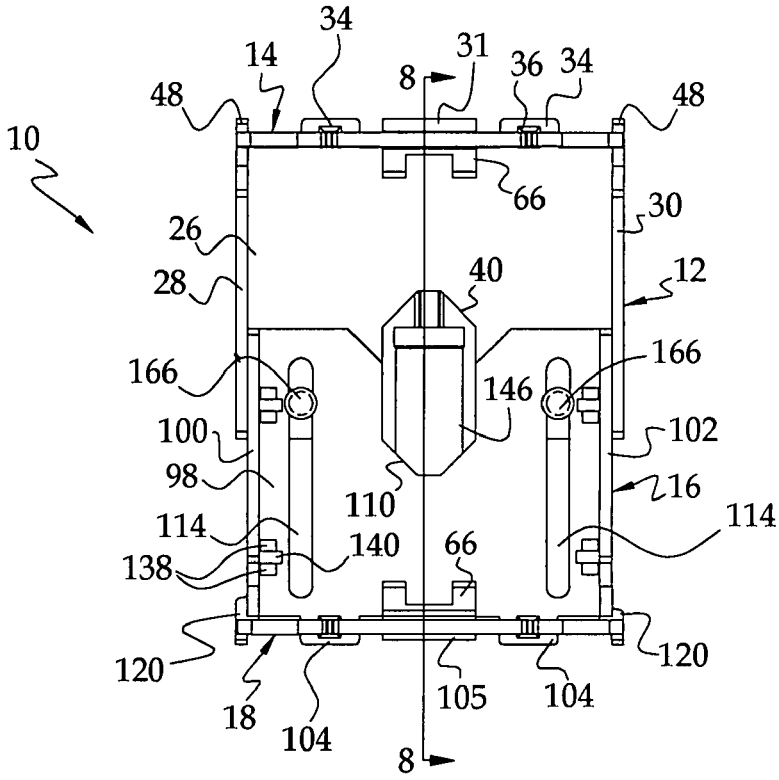
FIG. 7 is a front plan view of the laboratory rack.

As best shown in FIGS. 3A and 3B, each locking projection 88, 90 has a leg portion 91 that extends from the frame 74 and a ramped hook portion 92 located at a distal end of the leg portion. A gap 94 between the locking projections 88, 90 enables the hook portions to move toward each other during insertion into their respective apertures 36 or 50. When fully inserted, the hook portions 92 preferably engage a recessed step portion 96 of their respective apertures 36 or 50 for securing the upper rack module 14 to the upper support portion 12.

Referring again to FIG. 3, the lower support portion 16 preferably includes a lower rear wall 98, lower side walls 100, 102 that extend forwardly from opposite ends of the lower rear wall, and a lower adjustment support 105 that extends rearwardly from the lower rear wall.

The lower rear wall 98 preferably includes a pair of lower rear tabs 104 that extend downwardly from a lower edge 106. A stepped aperture 108, similar to the stepped apertures 50 previously described, extends through each rear tab 104. A lower window 110 is formed in the rear wall 98 and extends downwardly from an upper edge 112 of the lower rear wall. A pair of elongate, vertically oriented slots 114 are formed in the lower rear wall 98 on either side of the lower window 110. The slots 114 are in alignment with the openings 38 of the upper rear wall when the upper and lower support portions are connected together. Side edges 116, 118 of the lower rear wall 98 extend between the lower edge 106 and upper edge 112 and are preferably chamfered at an angle of 45° to accommodate the lower side walls 100, 102. The distance between the side edges 116, 118 of the lower rear wall 98 is preferably smaller than the distance between the side edges 44, 46 of the upper rear wall 26 so that the lower support portion 16 can be telescopically received in the upper support portion 12 during use. However, it will be understood that the lower rear wall may be wider than the upper rear wall so that the upper support portion can be telescopically received in the lower support portion.

Each of the lower side walls 100, 102 preferably includes a pair of lower side tabs 120 that extend below a lower edge 122 from an outer surface 124 of each side wall. A stepped aperture 126 extends through each side tab 120. When assembled, the tabs 120 and apertures 126 of one side wall are in alignment with the tabs and apertures of the other side wall. A forward edge portion 128 of each lower side wall 100, 102 is oriented at an angle of approximately 45° with respect to horizontal and an elongate side slot 130 preferably extends parallel with the forward edge portion 128. A rear edge 132 of the lower side wall 100 and a rear edge 134 of the lower side wall 102 extend between the lower edge 122 and an upper edge 136 and are preferably chamfered at an angle of 45° to accommodate the chamfered side edges 116 and 118, respectively, of the lower rear wall 98 during assembly.

The lower side walls are preferably connected to the lower rear wall by juxtaposing the rear chamfered edge 132 of the side wall 100 with the side chamfered edge 116 of the rear wall 98 and the rear chamfered edge 134 of the side wall 102 with the side chamfered edge 118 of the rear wall 98 so that the side walls 100, 102 are parallel with each other and perpendicular with the rear wall 98. As with the upper support portion 12, the side walls and rear wall of the lower support portion 16 can be connected together through any well known connection means such as adhesive bonding, welding, fastening, clamping, cooperative locking members on the side and rear walls, and so on. Preferably, spaced pairs of projections 138 extend forwardly from the lower rear wall 98 adjacent the side edges 116, 118 and corresponding spaced projections 140 extend inwardly from each side wall 100, 102 and between the projections 138 to facilitate alignment of the lower rear wall and lower side walls during assembly as well as to provide additional structural support. In addition to or alternatively of the connection means, the lower side walls and lower rear wall can be connected together by the lower rack module 18. It will be understood that the chamfered edges of the lower side walls and lower rear wall may be replaced with right-angle edges, rounded edges and so on. In accordance with a further embodiment of the invention, the lower rear wall 98 and the lower side walls 100, 102 may be integrally formed together with a living hinge located between each side wall and the rear wall so that the lower side walls can be bent to a transverse or perpendicular position with respect to the lower rear wall.

The lower adjustment support 105 is preferably identical in shape to the upper adjustment support 31 with a platform 64 and an arm 66 that extends upwardly from the platform. A groove 68 is formed in the arm and is sized for receiving a portion of the lower edge 106 located between the tabs 104 of the lower rear wall 98 during assembly of the lower adjustment support to the lower rear wall 98. As with the upper adjustment support, the lower adjustment support 105 may be secured to the lower rear wall 98 using well-known connection means such as press-fitting, adhesive bonding, welding, fastening, clamping, cooperative locking members on the arm 66 and lower rear wall 98, and so on. Alternatively, the lower adjustment portion 105 may be integrally formed with the lower rear wall 98.

The lower rack module 18 is preferably similar in shape and feature to the upper rack module 14, and is thus interchangeable with the upper rack module for accommodating a wide variety of column and receptacle tube sizes. As shown by way of example only, the lower rack module 18 includes a plurality of openings 142 that are larger in dimension than the openings 72 of the upper rack module 18 for receiving a plurality of columns or receptacle tubes, and an outer frame 74 surrounding the openings 142.

As shown in FIGS. 3, 5, 6 and 8, the adjustment mechanism 20 preferably includes an elongate gear 144 connected to the upper adjustment support 31, a hollow tube 146 connected to the lower adjustment support 105 for receiving the elongate gear 144, and a pinion 148 rotatably connected to the tube 146 for engaging the elongate gear 144 within the tube.

The elongate gear 144 preferably includes a shaft 150 with gear teeth 152 extending along its length and an mounting flange 154 located at an upper end of the shaft 150. The flange 154 is connected to an underside of the platform 64 of the adjustment support 31 through well-known connection means as previously described. Likewise, the tube 146 is connected to the platform 64 of the lower adjustment support 105 through well-known connection means as previously described. A slot 156 is formed in a wall of the tube 146 so that a portion of the pinion 148 extends into the tube hollow interior. Ears 158 extend rearwardly of the tube on either side of the slot 156 and a shaft 160 extends through apertures in the ears 158 and pinion 148 for rotatably mounting the pinion 148 onto the tube 146.

Figure 8:
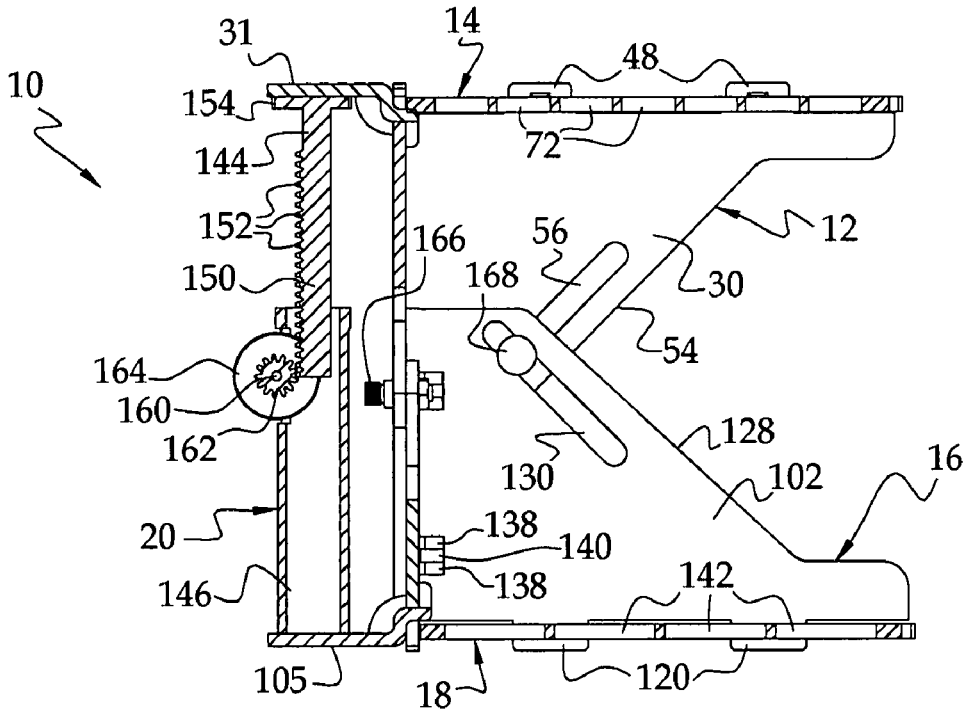
FIG. 8 is a sectional view of the laboratory rack taken along line 8-8 of FIG. 7 in the extended position.
Figure 9:
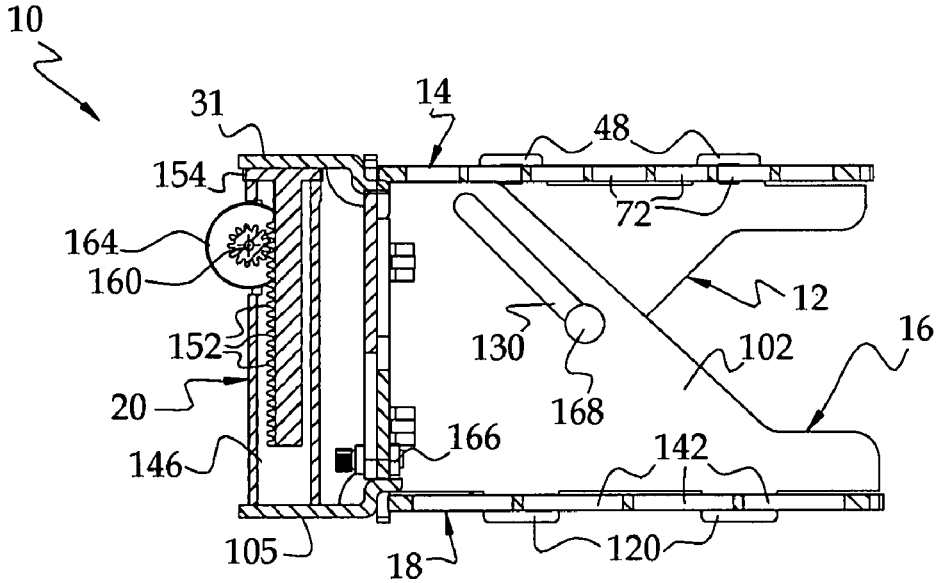
FIG. 9 is a sectional view of the laboratory rack similar to FIG. 8 in the retracted position.
Figure 10:
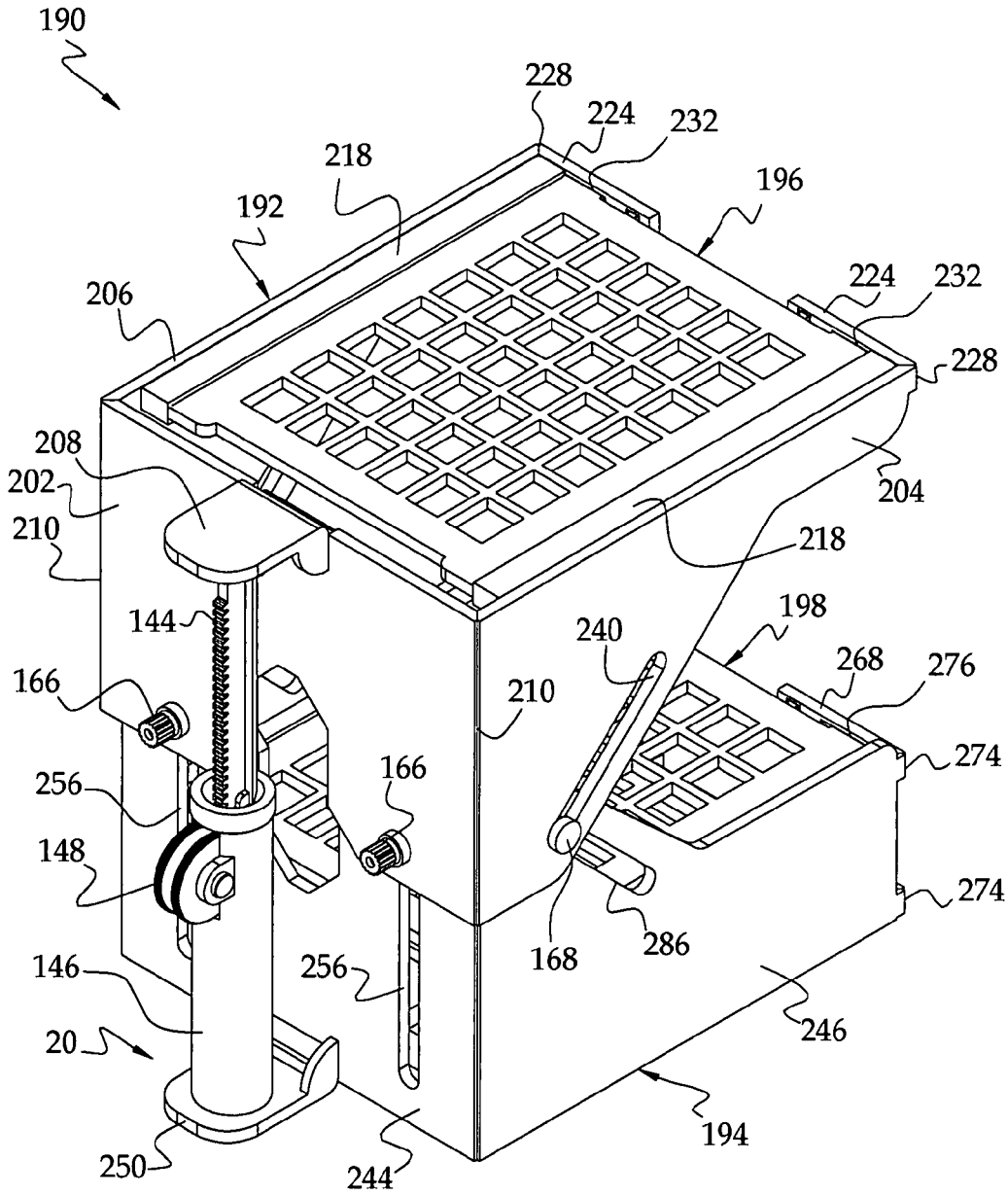
FIG. 10 is a rear isometric view of an adjustable and portable laboratory rack in an extended position in accordance with a second embodiment of the present invention.

The pinion 148 preferably includes a pinion gear 162 and a thumb wheel 164 connected to the pinion gear for rotation therewith. When the adjustment mechanism is assembled, as best shown in FIGS. 8 and 9, the pinion gear 162 engages the teeth 152 of the elongate gear 144 and, upon rotation of the thumbwheel by a user, causes relative linear sliding movement between the upper support portion 12 and lower support portion 16 to thereby adjust a height or distance between the upper rack module 14 and lower rack module 18 between the extended position (FIG. 8) and the retracted position (FIG. 9).

It will be understood that the hollow tube 146 can be connected to the upper adjustment support and the elongate gear 144 can be connected to the lower adjustment support. It will be further understood that the present invention is not limited to the adjustment mechanism as shown, but may include any mechanism for manually and/or automatically adjusting the relative position between the upper and lower rack modules, including screw-drive systems, solenoids, electric motors, linear bearings or guide tracks with friction clamps or discrete stop positions, and so on.

The upper support portion 12 and lower support portion 16 are connected together by positioning the lower support portion within the upper support portion until the elongate side slots 56 of the upper side walls 28, 30 are aligned with adjacent elongate side slots 130 of the lower side walls 100, 102 and the openings 38 of the upper rear wall 26 are aligned with adjacent vertical slots 114 of the lower rear wall 98. An adjustable fastener 166 is then inserted into each pair of aligned openings 38 and slots 114 and a fastener 168 is inserted into each pair of aligned slots 56, 130. Preferably, the adjustable fastener 166 includes an adjustment knob 170 with a threaded shaft 172 and a nut 174 that threads onto the shaft 172. The adjustment knob 170 is preferably accessible from the rear of the upper rear wall 26 and the nut 174 is located adjacent the inner surface of the lower rear wall 98 so that the upper and lower rear walls are sandwiched therebetween. The fastener 168 preferably includes a shaft 180 that extends through the pair of aligned slots 56, 130 and flanges 176, 178 located at opposite ends of the shaft 180 so that the upper side walls 28, 30 and their adjacent side walls 100, 102 are sandwiched between the flanges 176, 178. Preferably, the shaft is of sufficient length to permit relative sliding movement between the upper and lower side walls.

In accordance with a further embodiment of the invention, the fastener 168 may be similar in construction to the adjustable fastener 166 or may alternatively be in the form of a rivet, bushing, collar, or other means that permits relative sliding movement between the side walls. It will be understood that the adjustable fastener 166 may alternatively be associated with the side walls for clamping the side walls against relative sliding movement and the fastener 168 may be associated with the rear walls.

Figure 2:
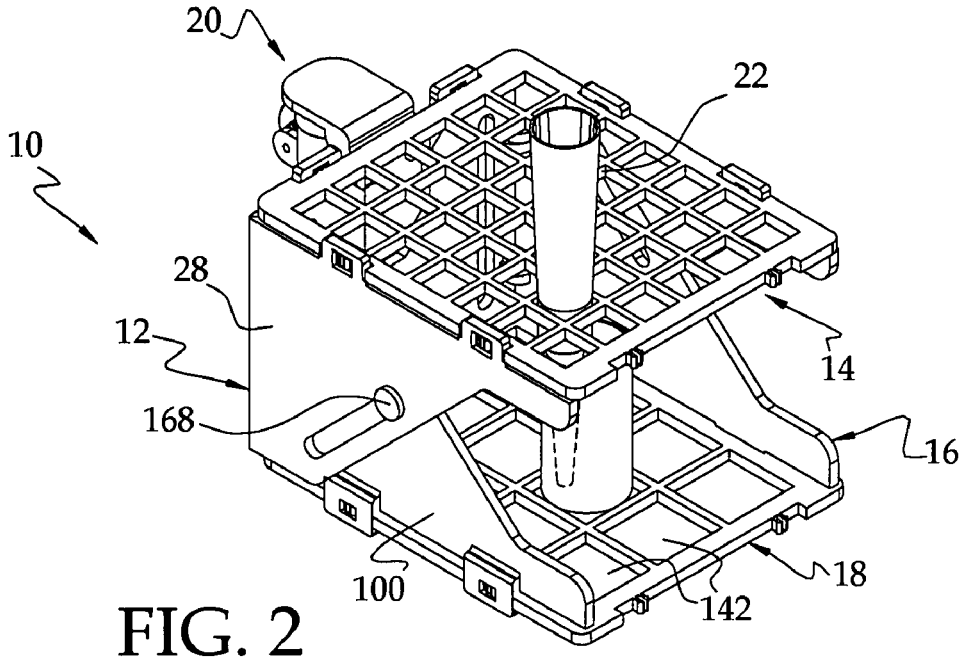
FIG. 2 is a front isometric view of the laboratory rack in a retracted position.

In use, and by way of example only, the rack assembly 10 is initially in the extended position as shown in FIG. 1. One or more columns 22, that may be appropriately pretreated for certain laboratory procedures such as filtration, chromatography, plasma preparation, affinity purification, and so on, are loaded into the openings of the upper rack module 14. Likewise, one or more receptacle tubes 24, that may contain media to be analyzed or exploited for similar procedures, are loaded into the openings of the lower rack module 18 in alignment with the column(s) 22. The adjustment knobs 170 are then loosened to permit relative sliding movement between the upper and lower support portions. When a desired distance between the upper and lower rack modules has been obtained, such as when the column(s) are positioned within the receptacle tubes as shown in FIG. 2, the adjustment knob can be tightened to releasably clamp the upper and lower rear walls to prevent relative movement between the upper and lower support portions and thus the upper and lower rack modules. Accordingly, the columns 22 and receptacle tubes 24 can be loaded, unloaded and precisely positioned with respect to each other to thereby substantially reduce or eliminate the possibility of cross contamination between adjacent samples.

Referring now to FIGS. 10-15, a rack assembly 190 in accordance with a further embodiment of the invention is illustrated. The rack assembly 190 preferably includes an upper support portion 192 with an upper rack module 196 and a lower support portion 194 with a plurality of lower rack modules 198, 200. As in the previous embodiment, an adjustment mechanism 20 is connected to the upper and lower support portions to control the relative sliding movement between the upper and lower support portions and adjust the distance between the upper and lower rack modules.

The upper and lower rack modules 196, 198, 200 are preferably somewhat similar in shape to the upper and lower rack modules 14, 18 previously described and may include a rectangular-shaped panel 70 with a plurality of openings 72 or 201 for receiving a plurality of columns or receptacle tubes and an outer frame 74 surrounding the openings. As shown, the openings 201 are smaller than the openings 72. Likewise, larger openings 142 (FIG. 3), such as found in the rack module 18, can also be provided either on one of the rack modules 196-200 or as a separate rack module. In this manner, a wide variety of columns, receptacle tubes and other lab paraphernalia can be accommodated. Although notches 76 and 82 are shown in the outer frame 74, they may be eliminated. Notably missing from each rack module 196, 198 and 200 is the pairs of opposing locking projections associated with the upper and lower rack modules 14, 18 of the previous embodiment as they are not necessary for mounting the rack modules to the upper and lower support portions 192, 194. However, it will be understood that the rack modules of the present embodiment can also include locking projections. As in the previous embodiment, the rack modules 196-200 are preferably interchangeable so that any rack module can be mounted in either the upper or lower support portion 192, 194 depending on the particular needs of the user.

The upper support portion 192 preferably includes an upper rear wall 202, upper side walls 204, 206 that extend forwardly from opposite ends of the upper rear wall, and an upper adjustment support 208 that extends rearwardly from the upper rear wall. Preferably, the upper rear wall 202 is integrally connected to the upper side walls 204, 206 through living hinges 210 that are formed simultaneously with the rear and side walls during molding, machining or other manufacturing operations so that the side walls can be bent to a transverse or perpendicular position with respect to the rear wall. However, it will be understood that the rear and side walls can be connected together through any well known connection means, as discussed above with respect to the rack assembly 10.

The upper rear wall 202 preferably includes an upper window 212 that extends upwardly from a lower edge 214 and a pair of openings 216 located on either side of the upper window 212.

Each of the upper side walls 204, 206 preferably includes an elongate, horizontally extending track 218 that projects inwardly from the side wall and extends adjacent to and parallel with an upper side wall edge 220. Each elongate track includes a channel 222 that is sized for slidably receiving the upper rack module 196. A locking segment 224 is pivotally connected to a forward end 226 of the upper side wall, preferably through an integrally formed living hinge 228. However, it will be understood that the side walls and locking segments can be separately formed and pivotally connected together through separate hinges, flexible strips or any other well known pivoting means. The locking segment 224 is in alignment with a forward open end 230 of the channel 222 and includes an elongate opening 232 for receiving a forward end portion 235 of the upper rack module 196 and an aperture 234 for receiving opposing locking projections, if the upper rack module is so equipped, when the locking segments 224 are rotated in a direction as represented by arrows 236 (FIG. 11) to secure the upper rack module 196 to the upper support portion 192. A forward edge portion 238 of each side wall 204, 206 is oriented at an angle of approximately 45° with respect to horizontal and an elongate side slot 240 preferably extends parallel with the forward edge portion.

The upper adjustment support 208 preferably includes a platform 64 and an arm 242 that extends downwardly from the platform. The arm is connected to the upper rear wall 202 through well-known connection means such as adhesive bonding, welding, fastening, clamping, and so on. Alternatively, the upper adjustment support 208 may be integrally formed with the upper rear wall 202.

The lower support portion 194 preferably includes a lower rear wall 244, lower side walls 246, 248 that extend forwardly from opposite ends of the lower rear wall, and a lower adjustment support 250 that extends rearwardly from the lower rear wall. Preferably, the lower rear wall 244 is integrally connected to the lower side walls 246, 248 through living hinges 249 that are formed simultaneously with the rear and side walls during molding, machining or other manufacturing operations so that the side walls can be bent to a transverse or perpendicular position with respect to the rear wall. However, it will be understood that the rear and side walls can be connected together through any well known connection means, as discussed above with respect to the rack assembly 10.

The lower rear wall 244 preferably includes a lower window 252 that extends downwardly from an upper edge 254 and a pair of elongate, vertically oriented slots 256 located on either side of the lower window 252. The slots 256 are in alignment with the openings 216 of the upper rear wall 202 when the upper and lower support portions are connected together. The width of the lower rear wall 244 is preferably less than the width of the upper rear wall 202 so that the lower support portion 194 can be telescopically received in the upper support portion 192 during use. However, it will be understood that the lower rear wall may be wider than the upper rear wall so that the upper support portion can be telescopically received in the lower support portion.

Each of the lower side walls 246, 248 preferably includes a pair of elongate, horizontally extending tracks 258, 260 that project inwardly from the side wall, with the first elongate track 258 extending adjacent to and parallel with an upper side wall edge 262 and the second elongate track 260 extending adjacent to and parallel with a lower side wall edge 264. Each elongate track 258, 260 preferably has a channel 266 that is sized for slidably receiving the lower rack module 198, 200. A pair of locking segments 268, 270 are pivotally connected to a forward end 272 of the upper side wall, preferably through an integrally formed living hinge 274. However, it will be understood that the side walls and locking segments can be separately formed and pivotally connected together through separate hinges, flexible strips or any other well known connection means. Each locking segment 268, 270 is in alignment with a forward open end of its associated channel and includes an elongate opening 276 for receiving a forward end portion 278 of one of the lower rack modules 198, 200 and an aperture 280 for receiving opposing locking projections, if the lower rack modules are so equipped, when the locking segments 268, 270 are rotated in a direction as represented by arrows 282 (FIG. 11) to secure one or more of the lower rack modules 198, 200 to the lower support portion 194. A forward edge portion 284 of each side wall 246, 248 is oriented at an angle of approximately 45° with respect to horizontal and an elongate side slot 286 preferably extends parallel with the forward edge portion.

The lower adjustment support 250 is preferably identical in shape to the upper adjustment support 208 with a platform 64 and an arm 242 that extends upwardly from the platform. As with the upper adjustment support 208, the arm 242 of the lower adjustment support 250 is connected to the lower rear wall 244 through well-known connection means such as adhesive bonding, welding, fastening, clamping, and so on. Alternatively, the lower adjustment support 250 may be integrally formed with the lower rear wall 244.

The upper support portion 192 and lower support portion 194 are preferably connected together with the adjustable fasteners 166 and slidable fasteners 168 in a similar manner as the upper and lower support portions 12, 16 of the previous embodiment, and therefore will not be further described.

Figure 11:
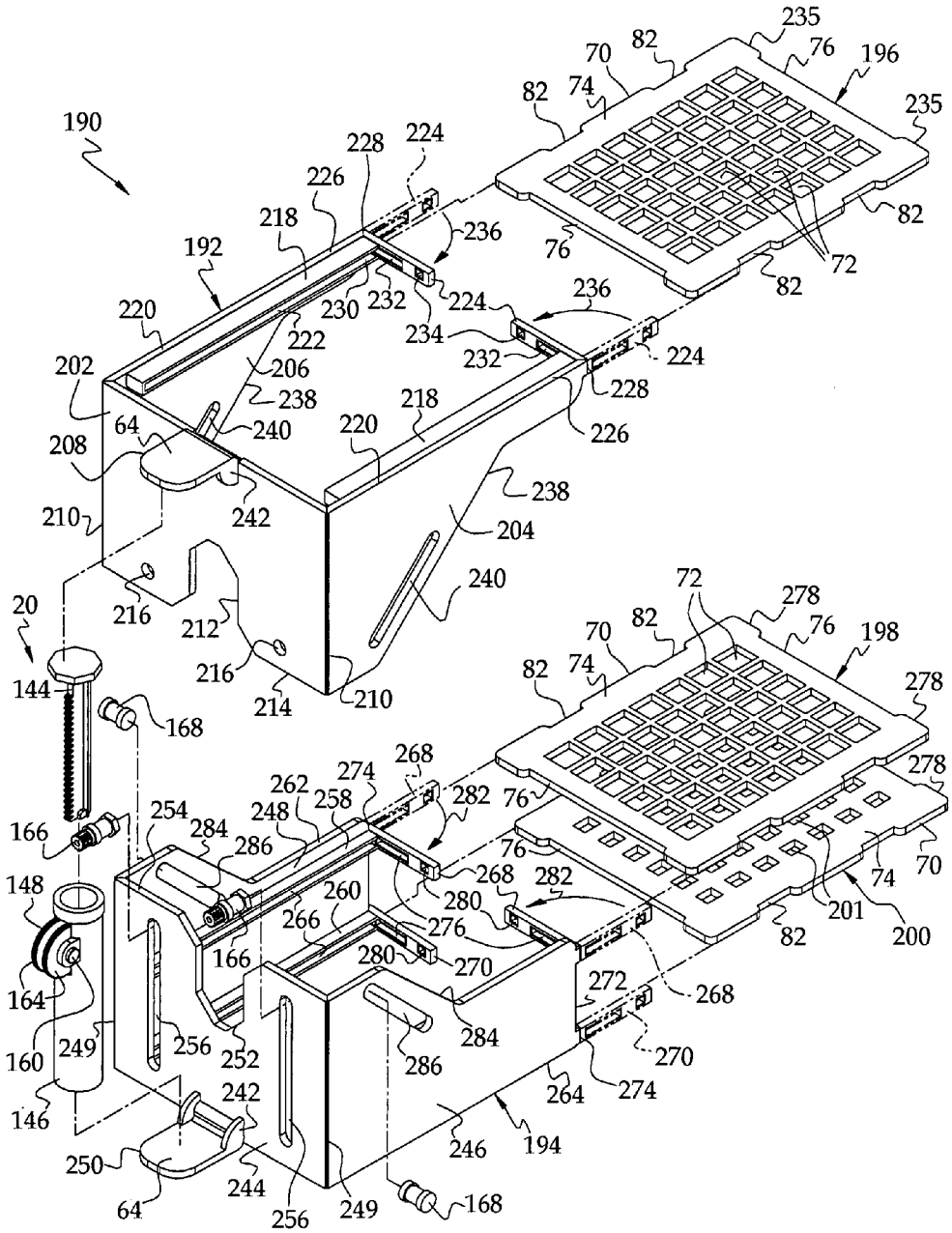
FIG. 11 is a rear isometric exploded view of the laboratory rack second embodiment.
Figure 12:
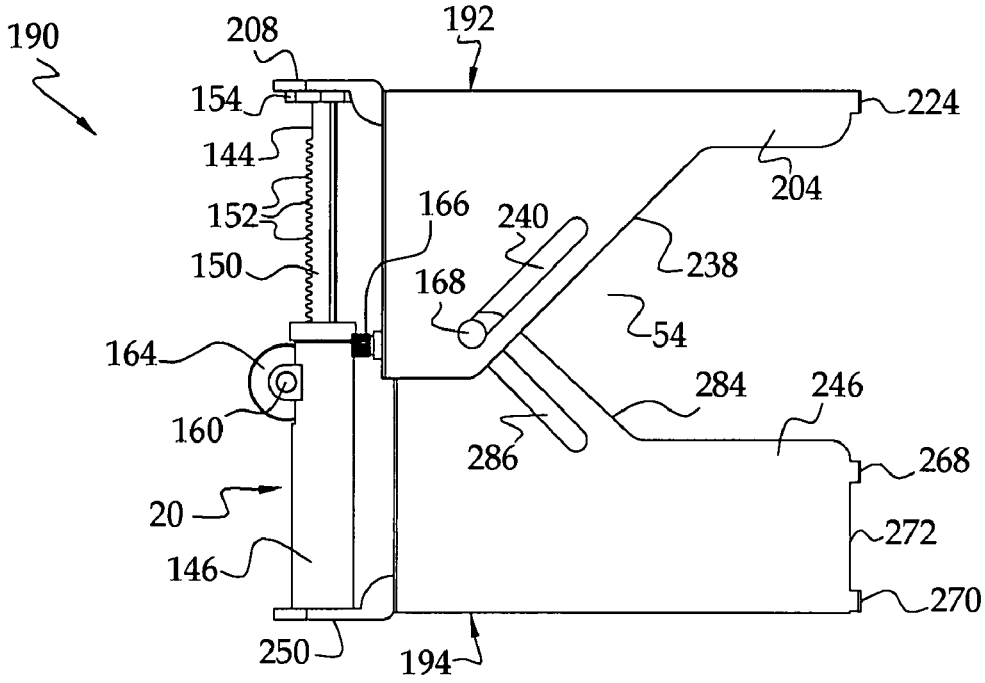
FIG. 12 is a side elevational view of the laboratory rack second embodiment.
Figure 13:
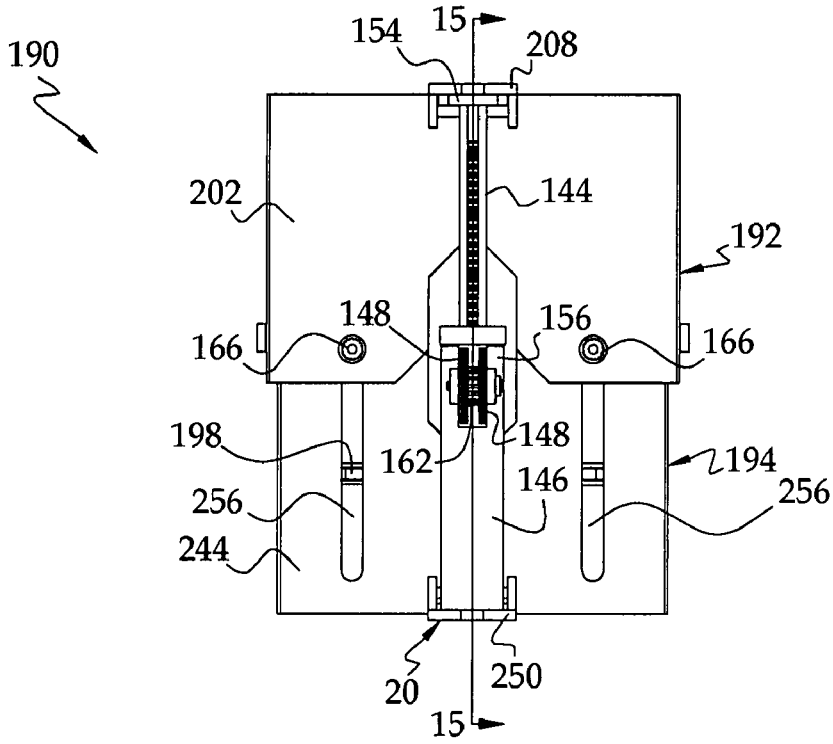
FIG. 13 is a rear elevational view of the laboratory rack second embodiment.
Figure 14:
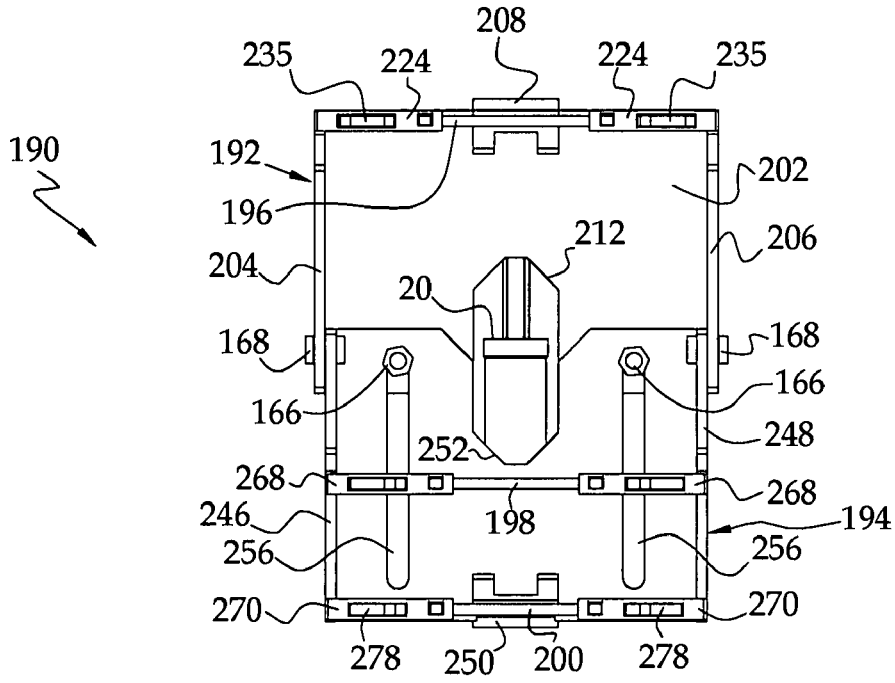
FIG. 14 is a front elevational view of the laboratory rack second embodiment.
Figure 15:
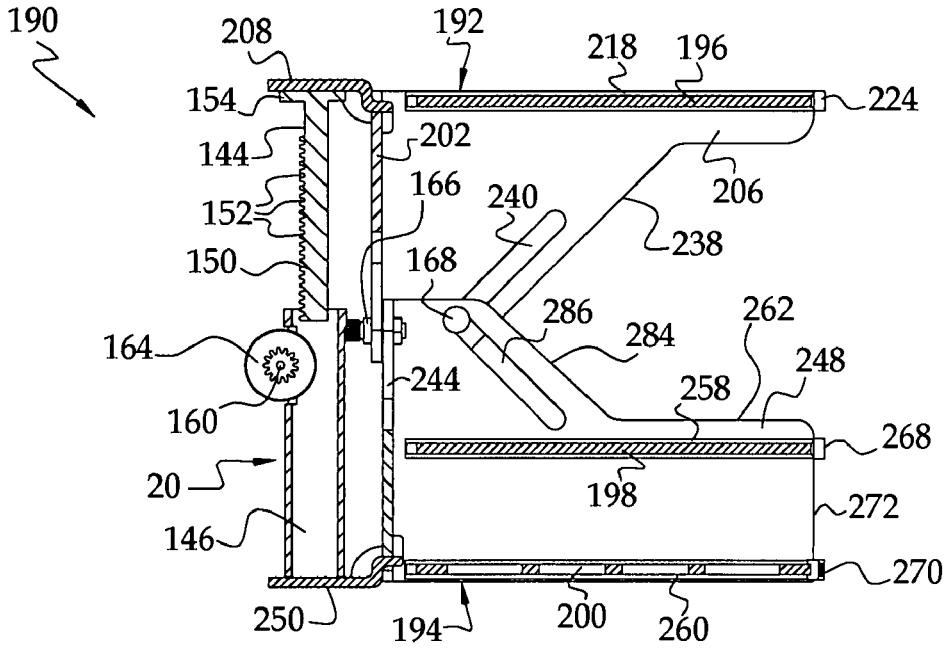
FIG. 15 is a sectional view of the laboratory rack taken along line 15-15 of FIG. 13.
Figure 16:
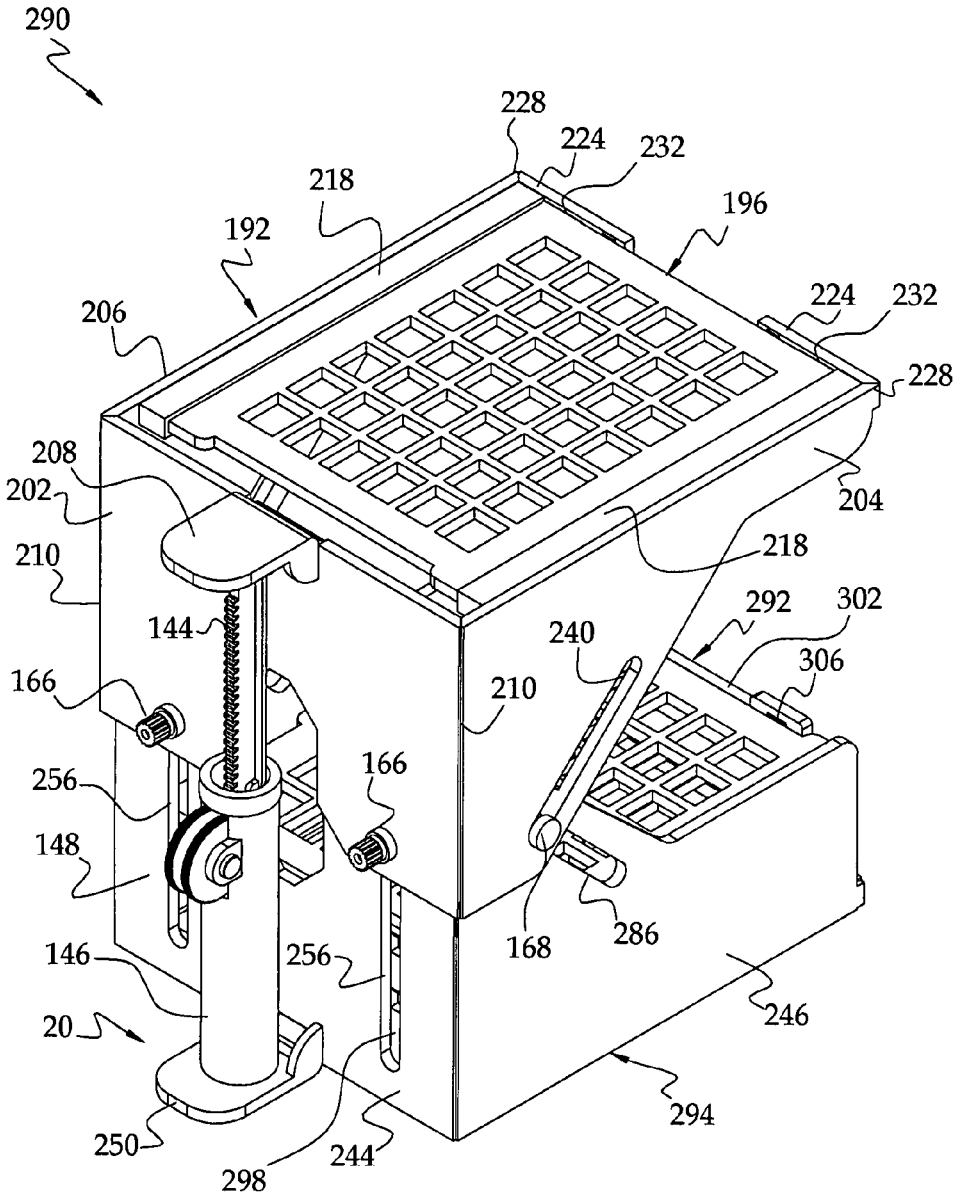
FIG. 16 is a rear isometric view of an adjustable and portable laboratory rack in an extended position in accordance with a third embodiment of the present invention.
Figure 17:
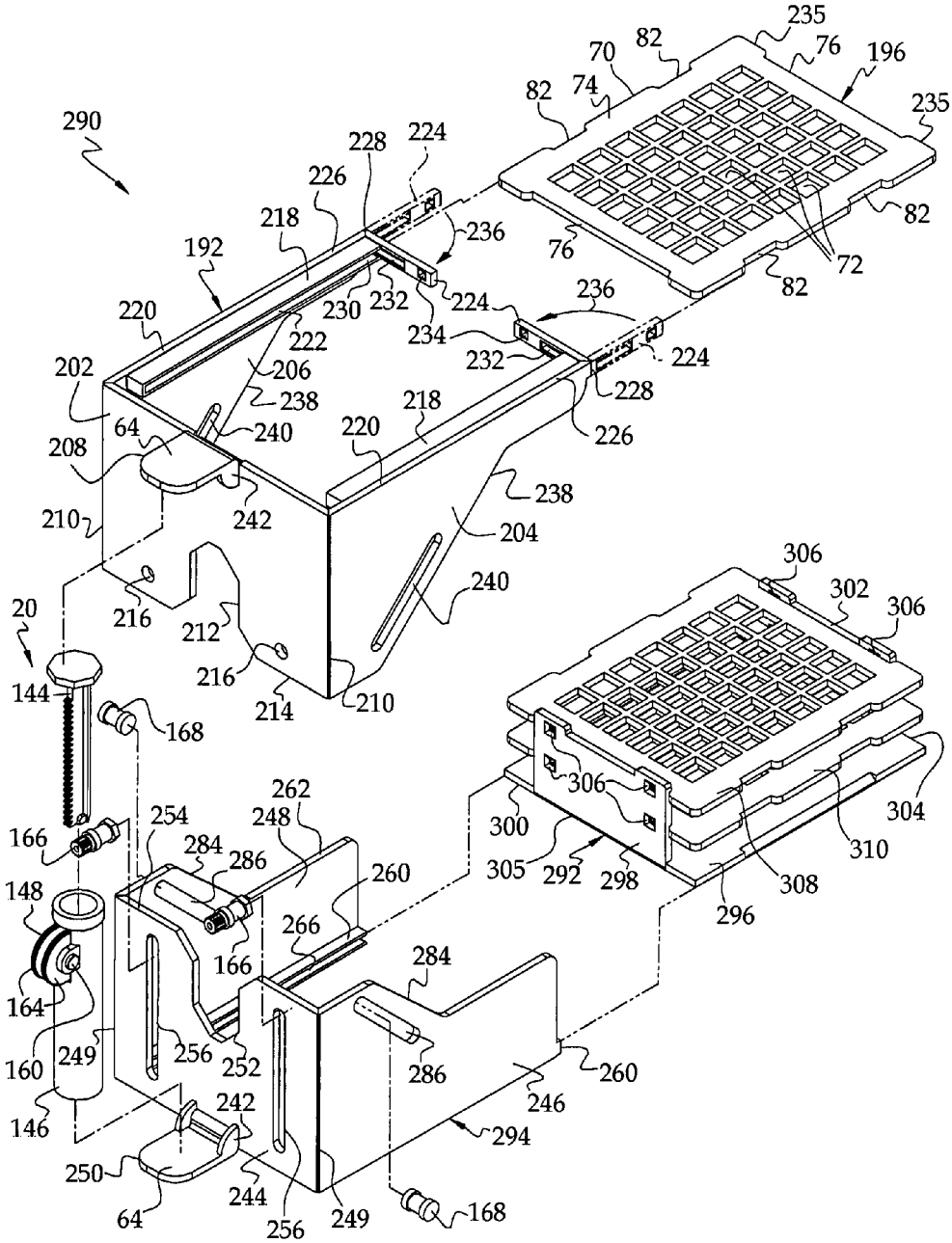
FIG. 17 is a rear isometric exploded view of the laboratory rack third embodiment.
Figure 18:
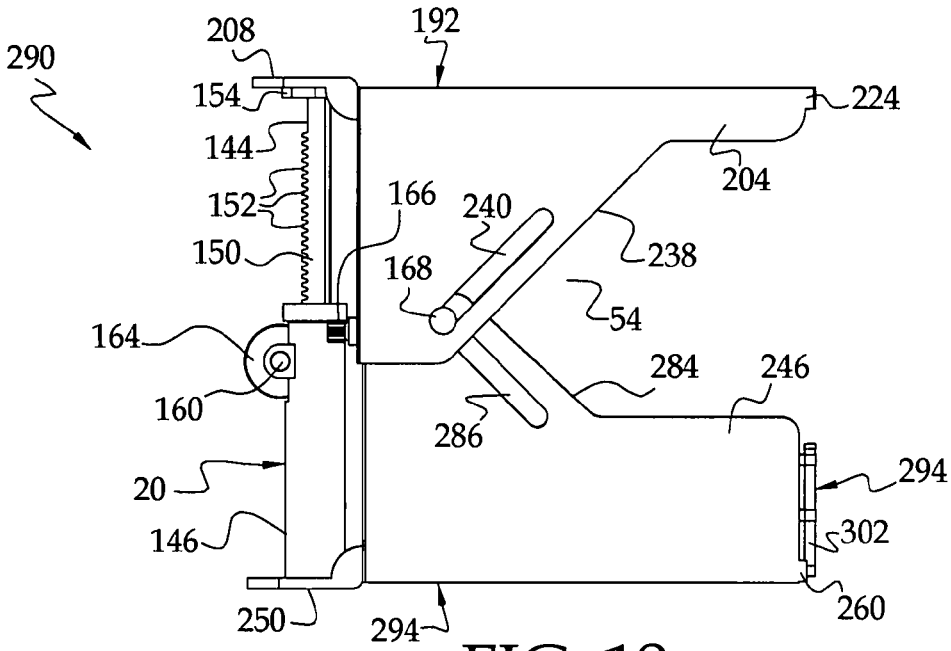
FIG. 18 is a side elevational view of the laboratory rack third embodiment.
Figure 19:
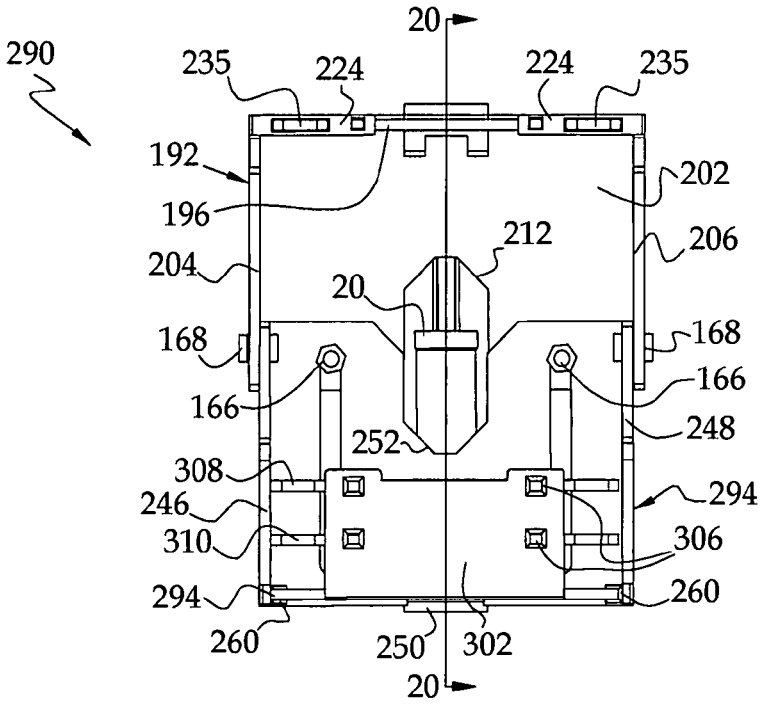
FIG. 19 is a front elevational view of the laboratory rack third embodiment.
Figure 20:
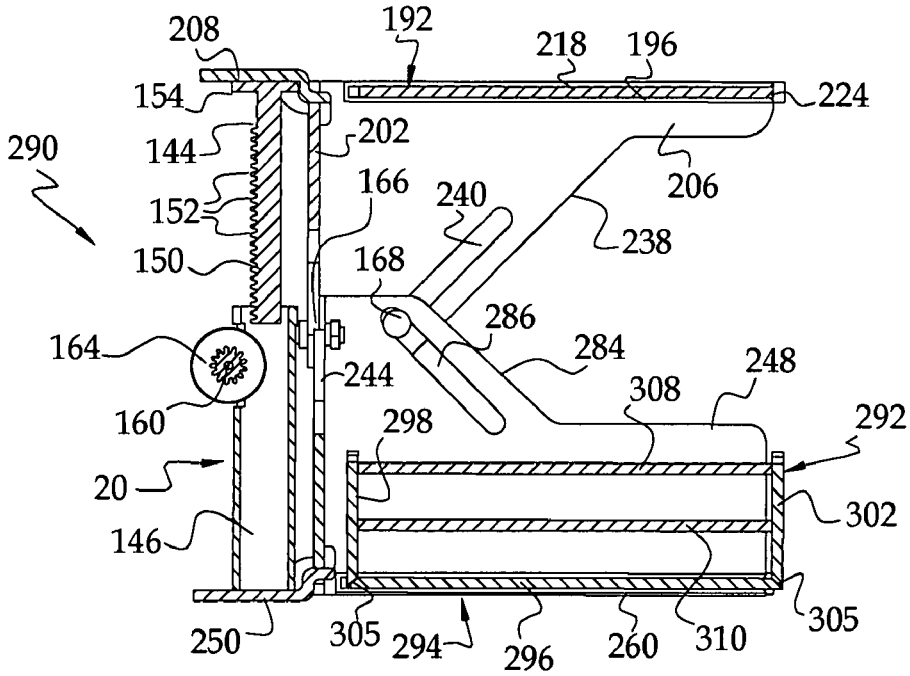
FIG. 20 is a sectional view of the laboratory rack taken along line 20-20 of FIG. 19.
Figure 21:
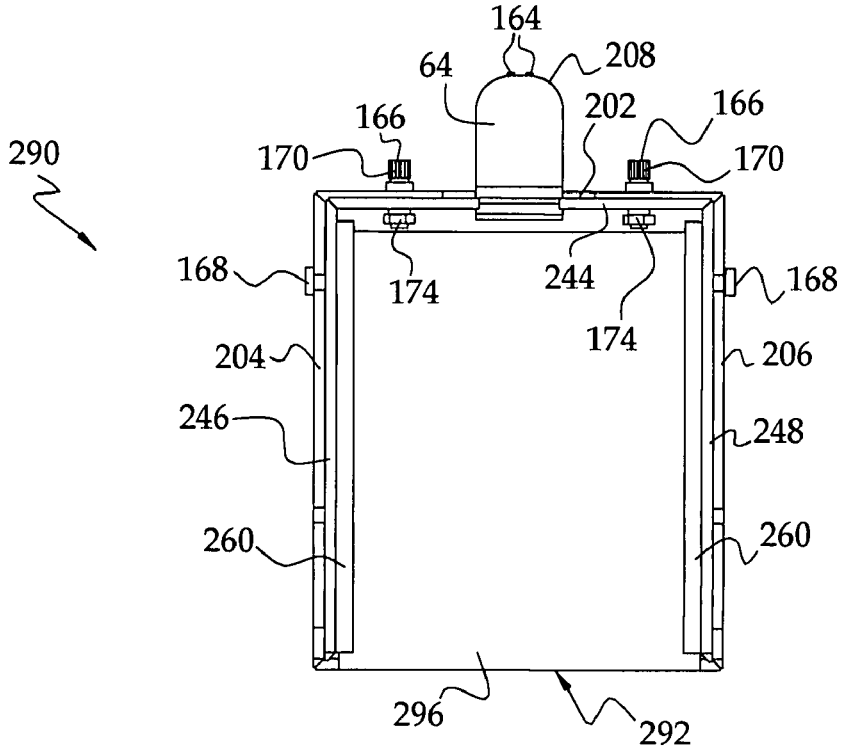
FIG. 21 is a bottom plan view of the laboratory rack third embodiment.

When it is desirous to install one or more rack modules 196, 198 or 200 into either the upper support portion 192 or lower support portion 194, one or more pairs of locking segments 224, 268 or 270 are opened to the position shown in phantom line in FIG. 11. A rack module 196, 198, 200 is then inserted into opposing pairs of channels 222, 258 or 266 of the opposing pairs of tracks 218, 258 or 260, respectively, by sliding the rack module along the channels. The pairs of locking segments 224, 268 or 270 are then rotated to a closed or locked position, as represented by arrows 236 and 282, to thereby hold the rack modules in the support members. When any of the rack modules includes opposing locking projections 88, 90 as shown for example in FIGS. 3A and 3B, the apertures 234, 280 in the locking segments receive the locking projections to further secure the rack modules to the support members. When it is desirous to remove one or more rack modules, the above procedure is reversed.

The provision of two or more lower rack modules is especially advantageous since it provides a greater stability for uniformly-shaped tube receptacles when rack modules with similarly sized openings are used. In addition, the provision of various rack modules with different sized openings provides greater stability for receptacles that are non-uniform in shape. It will be understood that the lower rack portion may be modified to hold more than two rack modules. It will be further understood that the upper support portion may be modified in a similar manner to hold two or more rack modules.

Referring now to FIGS. 16-21, a rack assembly 290 in accordance with a further embodiment of the invention is illustrated. The rack assembly 290 is somewhat similar in construction to the rack assembly 190 previously described, with the exception that a plurality of lower rack modules are positioned within a tray 292 which is in turn removably mounted on the lower support portion 294. The lower support portion 294 is also similar in construction to the lower support portion 194 previously described, with the exception that only a single pair of tracks 260 are provided on the lower side walls 246, 248 and the lower locking segments 268, 270 may be removed.

The tray 292 preferably includes a bottom panel 296, a rear panel 298 extending upwardly from a rear edge 300 of the bottom panel, and a front panel 302 extending upwardly from a front edge 304 of the bottom panel. Preferably, the rear panel 298, front panel 304 and bottom panel 296 are integrally connected together through living hinges 305 that are simultaneously formed with the panels during molding, machining or other manufacturing operations so that the front and rear panels can be bent to a vertical position with respect to the bottom panel. However, it will be understood that the bottom, rear and front panels can be connected together through any well known connection means, as discussed above. Each of the rear and front panels includes aligned stepped apertures 306 for receiving locking projections 88, 90 (FIGS. 3A, 3B) of lower rack modules 308, 310 so that the lower rack modules can be vertically stacked. Each rack module 308, 310 is similar in construction to the rack modules 14, 18 (FIG. 3) previously described, with the exception that side locking projections have been removed. However, it will be understood that the side locking projections may be provided as in the FIG. 3 embodiment. Moreover, although the bottom panel 296 is shown as being solid in construction, it may be provided with openings for receiving one or more receptacle tubes or the like.

In use, the tray 292 can be preloaded with one or more rack modules having similar or different sized openings. The tray 292 can then be slid into the lower support portion 294 by aligning the bottom panel 296 with the pair of tracks 260 of the lower side panels 246, 248. It will be understood that the tray 292 can be modified to receive more than two rack modules. It will be further understood that the upper support portion 192 can also receive the tray 292.

It will be understood that changes can be made to the upper and lower support portions and upper and lower rack modules in each of the above-described embodiments without departing from the spirit and scope of the present invention. By way of example, the upper support portion may be constructed to remain stationary while the lower support portion moves toward and away from the upper support portion; each support portion and associated rack module can be manufactured as a unitary structure; the elongate slots in each side wall can be oriented vertically or at any other angle; the upper tabs in the side walls may be eliminated and apertures may extend directly through the side wall; the rack modules may be attached to the side walls and/or rear walls through other connection means such as adhesive bonding, welding, fastening, clamping, and so on; the windows in the upper and rear walls may be eliminated; the upper and lower rack modules and their associated support portions may have different shapes such as triangular, circular, square, oval, and so on; the slots may be eliminated in rear wall and/or side walls and replaced with tongue and groove joints, linear bearings or any guiding mechanism for ensuring linear movement between the upper and lower rack modules.

It will be understood that the term "preferably" as used throughout the specification refers to one or more exemplary embodiments of the invention and therefore is not to be interpreted in any limiting sense. It will be further understood that the term "connect" and its various derivatives as may be used throughout the specification refer to components that may be permanently or removably joined together either directly or through one or more intermediate members. In addition, terms of orientation and/or position as may be used throughout the specification, such as upper, lower, rear, side, forward, horizontal, vertical, inner, and so on, as well as their derivatives and equivalent terms, relate to relative rather than absolute orientations and/or positions.

It will be appreciated by those skilled in the art that changes could be made to the embodiments described above without departing from the broad inventive concept thereof. It will be understood, therefore, that this invention is not limited to the particular embodiments disclosed, but is intended to cover modifications within the spirit and scope of the present invention as defined by the appended claims.

What is claimed is:

1. A laboratory rack assembly comprising:

an upper support portion, wherein the upper support portion comprises an upper rear wall and upper side walls extending forwardly from opposite ends of the upper rear wall, the upper rack module being removably connected to at least the upper side walls;

an upper rack module connected to the upper support portion, the upper rack module being configured to receive at least one column;

a lower support portion, wherein the lower support portion comprises a lower rear wall and lower side walls extending forwardly from opposite ends of the lower rear wall, the lower rack module being removably connected to at least the lower side walls;

a lower rack module connected to the lower support portion, the lower rack module being configured to receive at least one receptacle tube;

at least one of the rack modules being removably connected to at least one of the support portions;

the upper and lower support portions being connected together for relative sliding movement;

an upper side slot formed in each of the upper side walls and a lower side slot formed in each of the lower side walls such that the upper and lower side slots of adjacent upper and lower side walls are in overlapping relationship, and further comprising a fastener extending through a pair of overlapping side slots to thereby guide the relative sliding movement between the upper and lower support portions; and an adjustment mechanism operably associated with the upper and lower support portions for adjusting a position of one support portion with respect to the other support portion to thereby vary the distance between the upper and lower rack modules and to control the relative sliding movement between the upper and the lower support portions, wherein the adjustment mechanism comprises an elongate gear connected to one of the upper and lower rear walls and a pinion rotatably connected to the other of the upper and lower rear walls for engaging the elongate gear such that rotation of the pinion causes linear movement of the elongate gear and thus linear sliding movement between the upper and lower support portions and said adjustment mechanism further comprises a hollow tube connected to the other of the upper and lower rear walls for receiving the elongate gear, the pinion being rotatably connected to the tube.

2. A rack assembly according to claim 1, wherein the upper and lower rack modules are removably connected to the upper and lower support portions, respectively.

3. A rack assembly according to claim 2, wherein the upper and lower rack modules are interchangeable.

4. A rack assembly according to claim 1, wherein the lower rack module is removably connected to the lower support portion.

5. A rack assembly according to claim 4, wherein the lower rack module comprises first and second lower rack panels.

6. A rack assembly according to claim 5, wherein each lower rack panel comprises a plurality of openings for receiving a plurality of receptacle tubes.

7. A rack assembly according to claim 6, wherein the openings of the first lower rack panel are smaller in size than the openings of the second lower rack panel.

8. A rack assembly according to claim 7, wherein the lower rack module further comprises a third lower rack panel located below the first and second lower rack panels, the third lower rack panel being devoid of openings.

9. A rack assembly according to claim 8, wherein the lower rack module further comprises a support tray removably connected to the lower support portion, the lower rack panels being located in the support tray in a vertically stacked arrangement.

10. A rack assembly according to claim 5, wherein the lower rack module further comprises a support tray removably connected to the lower support portion, the lower rack panels being located in the support tray in a vertically stacked arrangement.

11. A rack assembly according to claim 5, wherein each rack module comprises a panel with a plurality of openings for receiving a plurality of columns or receptacle tubes and an outer frame surrounding the openings.

12. A rack assembly according to claim 11, wherein the side walls of the upper support portion comprise aligned horizontally extending tracks for slidably receiving the outer frame of the upper rack module.

13. A rack assembly according to claim 12 wherein the side walls of the lower support portion comprise aligned horizontally extending tracks for slidably receiving the outer frame of the lower rack module.

14. A rack assembly according to claim 12, wherein the lower rack module comprises a support tray removably connected to the lower support portion, and further wherein the lower rack module comprises a plurality of lower rack panels located in the support tray in a vertically stacked arrangement.

15. A rack assembly according to claim 14, wherein the side walls of the lower support portion comprises aligned horizontally extending tracks for slidably receiving the support tray.

16. A rack assembly according to claim 14, wherein at least two of the lower rack panels comprise a plurality of openings for receiving a plurality of receptacle tubes.

17. A rack assembly according to claim 16, wherein the openings of one lower rack panel are smaller in size than the openings of the other lower rack panel.

18. A rack assembly according to claim 11, wherein the side walls of the upper and lower support portions comprise aligned side apertures and the outer frames of the upper and lower rack modules comprise locking side projections for snap-fit engagement with the side apertures to thereby connect the upper and lower rack modules to the upper and lower support portions, respectively.

19. A rack assembly according to claim 18, wherein the rear wall of each support portion comprises rear apertures and the outer frames of the upper and lower rack modules comprise locking rear projections for snap-fit engagement with the rear apertures to thereby connect the rear wall of each support portion to its respective side walls.

20. A rack assembly according to claim 1, wherein each side wall is connected to its associated rear wall by a living hinge.

21. A rack assembly according to claim 1, wherein the upper slots are slanted at a first angle and the lower slots are slanted at a second angle greater than the first angle with respect to horizontal.

22. A rack assembly according to claim 21, wherein the second angle is approximately 90 degrees greater than the first angle.

23. A rack assembly according to claim 22, and further comprising a pair of rear slots formed in one of the upper and lower rear walls and a pair of rear openings formed in the other of the upper and lower rear walls such that the rear slots are in overlapping relationship with the rear openings, and further comprising a fastener extending through each pair of overlapping slots and openings to thereby guide relative sliding movement between the upper and lower support portions.

24. An adjustable laboratory rack comprising:

an upper support portion having an upper rear wall and upper side walls extending forwardly from opposite ends of the upper rear wall and an upper rack module extending between the upper side walls;

a lower support portion having a lower rear wall and lower side walls extending forwardly from opposite ends of the lower rear wall and a lower rack module extending between the lower side walls;

the upper and lower support portions being connected together for relative sliding movement between an extended rack position and a contracted rack position;

an upper side slot formed in each of the upper side walls and a lower side slot formed in each of the lower side walls such that the upper and lower side slots of adjacent upper and lower side walls are in overlapping relationship, and further comprising a fastener extending through a pair of overlapping side slots to thereby guide relative movement between the upper and lower support portions; and an adjustment mechanism operably associated with the upper and lower support portions for adjusting a position of one support portion with respect to the other support portion and to control the relative sliding movement between the upper and the lower support portions, wherein the adjustment mechanism comprises an elongate gear connected to one of the upper and lower rear walls and a pinion rotatably connected to the other of the upper and lower rear walls for engaging the elongate gear such that rotation of the pinion causes linear movement of the elongate gear and thus linear sliding movement between the upper and lower support portions and said adjustment mechanism further comprises a hollow tube connected to the other of the upper and lower rear walls for receiving the elongate gear, the pinion being rotatably connected to the tube.

25. A rack assembly according to claim 24, wherein each rack module comprises a panel with a plurality of openings for receiving a plurality of columns or receptacle tubes and an outer frame surrounding the openings.

26. A rack assembly according to claim 25, wherein the side walls of the upper support portion comprise aligned horizontally extending tracks for slidably receiving the outer frame of the upper rack module.

27. A rack assembly according to claim 26, wherein the side walls of the lower support portion comprise aligned horizontally extending tracks for slidably receiving the outer frame of the lower rack module.

28. A rack assembly according to claim 26, wherein the lower rack module comprises a support tray removably connected to the lower support portion, and further wherein the lower rack module comprises a plurality of lower rack panels located in the support tray in a vertically stacked arrangement.

29. A rack assembly according to claim 28, wherein the side walls of the lower support portion comprise aligned horizontally extending tracks for slidably receiving the support tray.

30. A rack assembly according to claim 28, wherein at least two of the lower rack panels comprise a plurality of openings for receiving a plurality of receptacle tubes.

31. A rack assembly according to claim 28, wherein the openings of one lower rack panel are smaller in size than the openings of the other lower rack panel.

32. A rack assembly according to claim 25, wherein the side walls of the upper and lower support portions comprise aligned side apertures and the outer frames of the upper and lower rack modules comprise locking side projections for snap-fit engagement with the side apertures to thereby connect the upper and lower rack modules to the upper and lower support portions, respectively.

33. A rack assembly according to claim 32, wherein the rear wall of each support portion comprises rear apertures and the outer frames of the upper and lower rack modules comprise locking rear projections for snap-fit engagement with the rear apertures to thereby connect the rear wall of each support portion to its respective side walls.

34. A rack assembly according to claim 24, wherein each side wall is connected to its associated rear wall by a living hinge.

35. A rack assembly according to claim 24 wherein the upper slots are slanted at a first angle and the lower slots are slanted at a second angle greater than the first angle with respect to horizontal.

36. A rack assembly according to claim 35, wherein the second angle is approximately 90 degrees greater than the first angle.

37. A rack assembly according to claim 36, and further comprising a pair of rear slots formed in one of the upper and lower rear walls and a pair of rear openings formed in the other of the upper and lower rear walls such that the rear slots are in overlapping relationship with the rear openings, and further comprising a fastener extending through each pair of overlapping slots and openings to thereby guide relative sliding movement between the upper and lower support portions.

38. A rack assembly according to claim 24, wherein the upper and lower rack modules are removably connected to the upper and lower support portions, respectively.

39. A rack assembly according to claim 24, wherein the upper and lower rack modules are interchangeable.

* * * * *